United States Patent [19]

Schibbye

[11] 4,140,445

[45] Feb. 20, 1979

[54] SCREW-ROTOR MACHINE WITH STRAIGHT FLANK SECTIONS

[75] Inventor: Cauritz B. Schibbye, Saltsjö-Duvnäs, Sweden

[73] Assignee: Svenka Rotor Haskiner Aktiebolag, Nacka, Sweden

[21] Appl. No.: 782,017

[22] Filed: Mar. 28, 1977

Related U.S. Application Data

[63] Continuation of Ser. No. 552,332, Feb. 24, 1975, abandoned.

[30] Foreign Application Priority Data

Mar. 6, 1974 [GB] United Kingdom ..... 10070/74

[51] Int. Cl.[2] ..... F01C 1/16; F04C 17/12; F16H 55/08

[52] U.S. Cl. ..... 418/201; 74/458

[58] Field of Search ..... 74/458, 462; 418/150, 418/197, 201–203

[56] References Cited

U.S. PATENT DOCUMENTS

| | | | |
|---|---|---|---|
| 2,622,787 | 12/1952 | Nilsson | 418/202 |
| 3,245,612 | 4/1966 | Nilsson et al. | 418/201 |
| 3,414,189 | 12/1968 | Persson | 418/201 |
| 3,423,017 | 1/1969 | Schibbye | 418/201 |
| 3,773,444 | 11/1973 | Koch | 418/201 |
| 3,787,154 | 1/1974 | Edstrom | 418/201 |

*Primary Examiner*—John J. Vrablik
*Attorney, Agent, or Firm*—Flynn & Frishauf

[57] ABSTRACT

Screw rotor machine comprising male and female rotors, where the profile of the flanks of the female rotor comprises portions inside and outside the pitch circle thereof, which portions at the point of intersection with the pitch circle have a common tangent and different radii of curvature and the profiles of the flanks of the male rotor inside the pitch circle have a generally straight section.

31 Claims, 3 Drawing Figures

SCREW-ROTOR MACHINE WITH STRAIGHT FLANK SECTIONS

This is a continuation, of application Ser. No. 552,332, filed Feb. 24, 1975, now abandoned.

The present invention relates to a screw rotor machine and more specifically to the shape of the intermeshing rotors for such a machine.

BACKGROUND OF THE INVENTION

The rotors for such a machine comprise a female rotor provided with helical lands and intervening grooves having generally concave flanks at least the major portions of which are located inside the pitch circle of the rotor, and a male rotor provided with helical lands and intervening grooves having generally convex flanks at least the major portions of which are located outside the pitch circle of the rotor.

In most cases each land of the female rotors extends a short distance ouside the pitch circle forming an addendum and each groove of the male rotor extends a short distance inside the pitch circle forming a dedendum corresponding to said addendum. The flanks of the addendums and dedendums form minor portions of the complete flanks of the corresponding lands and grooves. Up to now each of said minor flank portions has been shaped so as to follow a circular arc having its centre on the pitch circle. In order to guarantee non-interference between cooperating minor flank portions the radius of the circular arc of the male rotor has been made considerably larger than that of the female rotor, said difference between the radii being of the order of 1 to 1%. Owing to the short extent of said minor flank portions and their location close to the pitch circles where the sliding between the flanks is a minimum, the leakage areas so obtained have been negligible.

Screw compressors having such flank profiles of the addendums have run quite satisfactorily when the rotors have been interconnected by means of synchronizing gears. Also in screw compressors with direct contact between the flanks such addendum and dedendum profiles have worked satisfactorily when the male rotor has been connected with a power source even though the torque transmitting surfaces of the major flank portions adjacent the pitch circles have been of limited size. Those surfaces have normally, in order to obtain flank contact adjacent to the pitch circles only, been provided with a smaller interflank clearance than that of the remaining flank potions in the way well known since the early thirties from the screw rotor pump field. In screw compressors with direct flank contact and the female rotor connected with a power source and using addendum and dedendum profiles of the earlier known type, some problems have arisen partly owing to the larger torque to be transmitted between the rotors and partly owing to the fact that the points of contact of the driving female rotor flank lie inside the pitch circle whereas the points of contact of the driven male rotor flank lie outside the pitch circle, which means that at the points of contact the peripheral speed of the driving flank is lower than that of the driven flank.

Another disadvantage with the described known addendum and dedendum flank profiles is that they are complicated to manufacture and almost impossible to cut properly by a hob milling process.

One object of the present invention is to extend the area of the power transmitting flank surfaces of a pain of intermeshing rotors.

Another object of the invention is to shape the rotors such that at least a portion of the power transmitting surfaces are so located in relation to the respective pitch circles that the driving flank has a higher speed than that of the driven flank.

A further object of the invention is to shape the rotors so that they can be easily cut in a hob milling machine.

SUMMARY OF THE INVENTION

In accordance with the present invention, a pair of intermeshing rotors of a screw rotor machine have helical lands and intervening grooves and are adapted for rotation about parallel axes within a working space of the machine. One of the rotors is of female rotor type and is shaped such that each groove flank thereof has a major portion located inside the pitch circle of the rotor and a minor portion located outside the pitch circle of the rotor, the minor portion following a curve approaching the adjacent groove when moving from the pitch circle outwardly. The other of the rotors is of male rotor type and is shaped such that each land flank thereof has a major portion located outside the pitch circle of the rotor and a minor portion located inside thereof. In a plane perpendicular to the rotor axes, the major and minor flank portions of at least one flank of each female rotor groove at their common point on the pitch circle have different radii of curvature and a common tangent, the common tangent forming an angle of less than 30° with a radial line drawn through the common point of tangency from the center of the rotor.

BRIEF DESCRIPTION OF THE DRAWINGS

A preferred embodiment of the invention will now be described by way of example with reference to the accompanying drawings, in which.

DETAILED DESCRIPTION OF THE DRAWINGS

Figure 1:
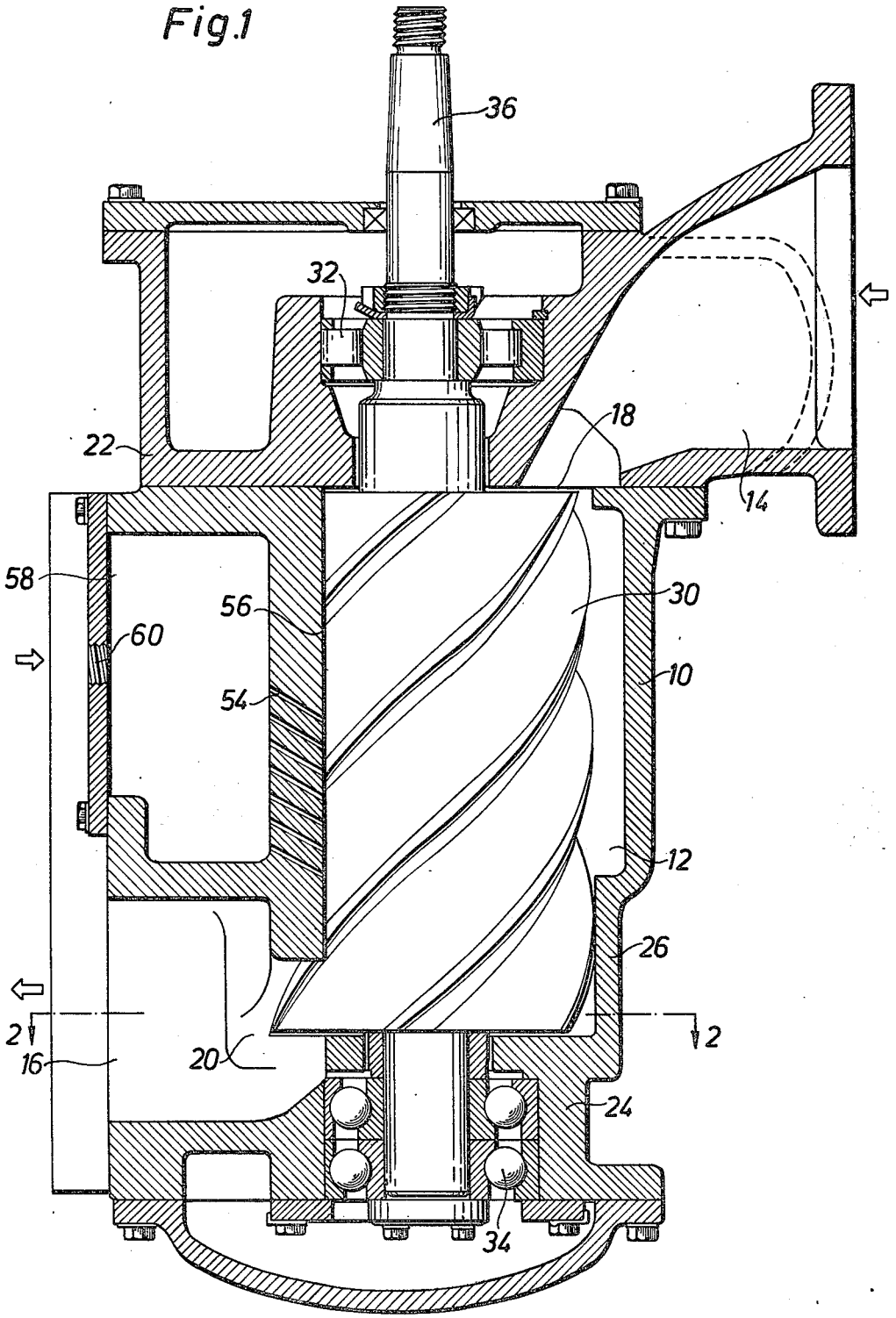
FIG. 1 shows a vertical section through a screw compressor taken on line 1—1 in FIG. 2.
Figure 2:
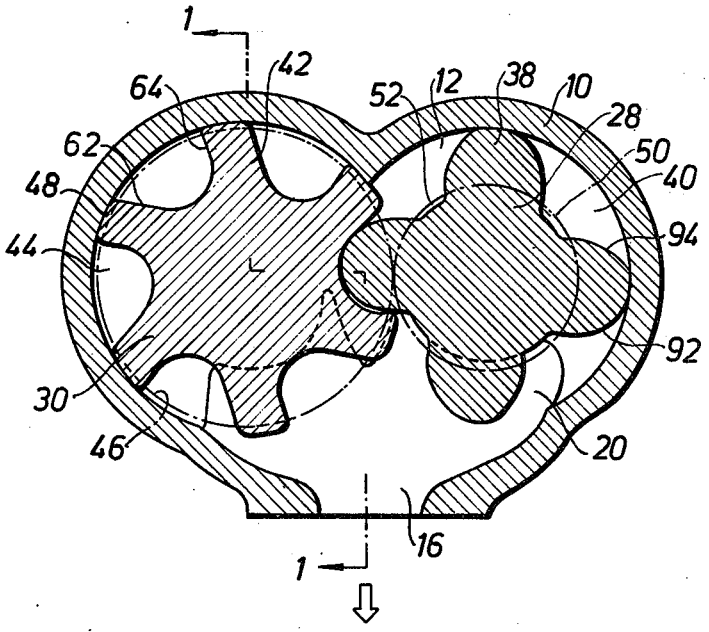
FIG. 2 shows a transverse section through the compressor of FIG. 1 taken on line 2—2 in FIG. 1.

The screw compressor shown in FIGS. 1 and 2 comprises a casing 10 forming a working space 12 substantially in the form of two intersecting cylindrical bores having parallel axes. The casing 10 is further provided with a low pressure channel 14 and a high pressure channel 16 for the working fluid, which channels communicate with the working space 12 through a low pressure port 18 and a high pressure port 20, respectively.

In the compressor shown the low pressure port 18 is located in its entirety in the low pressure end wall 22 of the working space 12 and extends mainly on one side of the plane containing the axes of the bores. The high pressure port 20 of the compressor shown is located partly in the high pressure end wall 24 of the working space 12 and partly in its barrel wall 26 and it is in its entirety located on the side of the plane through the bore axes opposite to the low pressure port.

In the working space 12 are provided two cooperating rotors, viz. a male rotor 28 and a female rotor 30, located with their axes coinciding with the bore axes. These rotors are journaled in the casing 10 in cylindrical roller bearings 32 in the low pressure end wall and in pairs of ball bearings 34 with shoulders in the high pressure end wall 24. The female rotor 30 is further provided with a stub shaft 36 projecting outside the casing 10.

The male rotor 28 has four helical lands 38 and intervening grooves 40 having a wrap angle of about 300°. The female rotor 30 has six helical lands 42 and intervening grooves 44 having a wrap angle of about 200°. The female rotor lands 42 are provided with addendums 48 located radially outside the pitch circle 46 of the female rotor 30 and the male rotor grooves 40 are provided with corresponding dedendums 52 located radially inside the pitch circle 50 of the male rotor 28.

In the barrel wall 26 of the working space 12 are provided a plurality of oil injection channels 54 opening at the intersection line 56 between the two bores forming the working space 12. These channels 54 form communications between an oil supply chamber 58 and the working space 12. Oil is supplied to this chamber 58 from a pressure oil source not shown through a supply opening 60 under a pressure higher than the pressure prevailing in the working space 12 at the openings of the channels 54.

Figure 3:
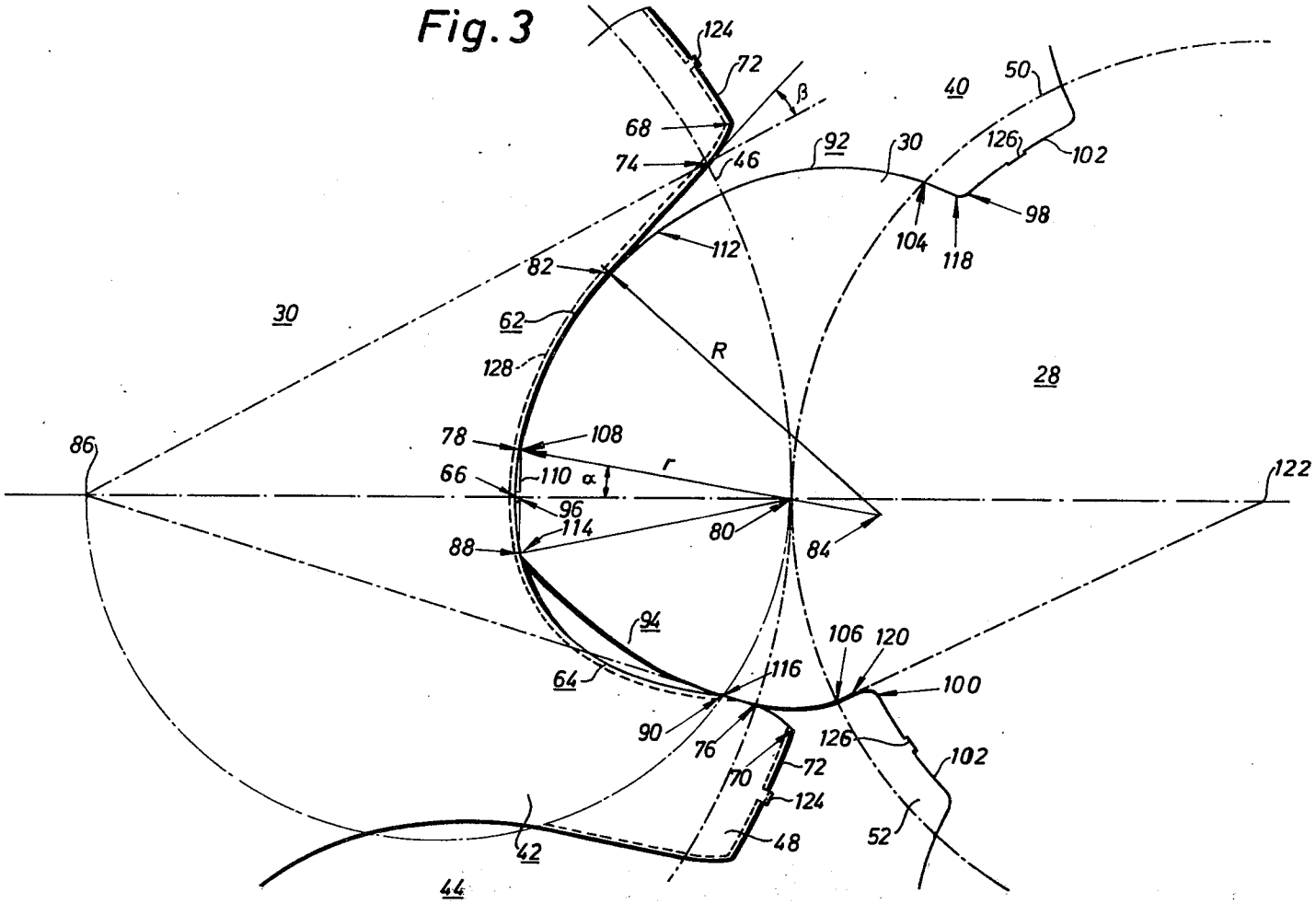
FIG. 3 shows a detail of FIG. 2 of a larger scale.

As seen in FIG. 3, each female rotor groove 44 comprises a first flank 62, being the leding flank when disposed in a compressor, and a second, trailing flank 64. Each of said flanks 62, 64 extends from a radially innermost point 66 of the groove 44 out to a point 68 and 70, respectively on the crest 72 of the adjacent land 42 which is located outside the pitch circle 46 of the rotor 30, which circle intersects the flanks 62, 64 at the points 74 and 76, respectively. Each flank 62, 64 has thus a major portion 66–74, 66–76 inside the pitch circle 46 and a minor portion 74–68, 76–70 outside the pitch circle 46.

The major portion 66–74 of the leading flank 62 is composed of three different sections. The first section 66–78 is shaped as a circular arc extending over an angle "$\alpha$" of about 10°, and having its center 80 located on the pitch circle 46, and a radius "r" with a length of about 40% of that of the pitch radius of the rotor 30. The second section 78–82 is shaped as a circular arc having its center 84 located outside the pitch circle 46 on an extension of the straight line 78–80, and a radius "R" having a length of about four thirds of that of the aforesaid radius "R". The third section 82–74 follows a straight line which at the point 82 forms a tangent to the circular arc with the radius "R" and at the point 74 on the pitch circle 46 forms an angle "$\beta$" of about 20° with a radial line drawn from the center 86 of the rotor 30.

The major portion 66–76 of the trailing flank 64 is also composed of three different sections. The first section 66–88 is a mirror image of the first section 66–78 of the leading flank 62. The second section 88–90 has at its inner end point 88 a tangent common to that of the first section 66–88. The outer end point 90 of the second section 88–90 is disposed on a circle having the pitch radius 86–80 as a diameter. Between those two points 88,90 the second section follows a curve of epicycloidal type which will be described later. The third section 90–76 follows a straight radial line drawn from the center 86 of the rotor 30.

Each male rotor land 30 comprises in the same way a leading flank 92 and a trailing flank 94. Each of said flanks 92, 94 extends from a summit 96 to a point 98 and 100, respectively, on the bottom portion 102 of the adjacent groove 40 which is located inside the pitch circle 50 of the male rotor 28, which pitch circle intersects the flanks 92, 94 at the points 104 and 106, respectively. Each flank 92,94 has thus a major portion 96-104, 96-106 outside the pitch circle 50 and a minor portion 104–98, 106–100 inside the pitch circle 50.

The major portion 96–104 of the leading flank 92 is composed of three different sections. The first section 96–108 is, except for a relieved portion 110 in order to provide a sealing strip at the summit 96, shaped as a circular arc conforming with the first section 66–78 of the leading flank 62 of the female rotor 30. The second section 108–112 is generated by the second section 78–82 of the leading flank 62 of the female rotor 30. The third section 112–104 is generated by the third section 82–74 of the leading flank 62 of the female rotor.

The major portion 96–106 of the trailing flank 94 is also composed of three different sections. The first section 96–114 is a mirror image of the first section 96–108 of the leading flank 92. The end point 114 of this first section further generates the epicycloidal, second section 88–90 of the trailing flank 64 of the female rotor 30. The second section 114–116 is generated by the point 90 on the trailing flank 64 of the female rotor 30. The third section 116–106 is generated by the third section 90–76 of the trailing flank 64 of the female rotor 30.

The minor portion 104–98 of the leading flank 92 of the male rotor 28 is composed of two different sections. The first section 104–118 follows a straight line forming a tangent to the third section 112–104 of the major portion 96–104 of the flank 92 at the point 104 on the pitch circle 50. The second section 118–98 is generated by the outermost point 68 of the leading female rotor groove flank 62. The point 118 of intersection between the flank sections 104–118, 118–98 is so located that the line 104–118 forms a tangent to the curve 118–98 at said point 118 and which tangent forms an angle of about 20° with a radial line drawn through the center of the rotor.

The minor portion 74–68 of the leading flank 62 of the female rotor 30 follows a curve generated by the first section 104–118 of the minor portion 104–98 of the leading flank 92 of the male rotor 28.

The minor portion 106–100 of the trailing flank 94 of the male rotor 28 is composed of two different sections. The first section 106–120 follows a straight line, the extension of which passes through the center 122 of the male rotor 28. This straight line 106–120 forms a tangent to the third section 116–106 of the major portion 96–106 of the trailing flank 94 at the point 106 on the pitch circle 50. The second section 120–100 is generated by the outermost point 70 of the trailing female rotor groove flank 64. The point 120 of intersection between the flank sections 106–120, 120–100 is so located that the line 106–120 forms a tangent to the curve 120–100 at said point 120.

The minor portion 76–70 of the trailing flank 64 of the female rotor 30 follows a curve generated by the first section 106–120 of the minor portion 106–100 of the trailing flank 94 of the male rotor 28.

The crest 72 of each female rotor land 42 is provided with a sealing strip 124 for improvement of the sealing against the barrel wall of the casing. The bottom portion 102 of each male rotor groove 40 is further provided with a slot 126 into and out of which the sealing strip 124 of the cooperating female rotor land 42 passes as the rotors 30, 28 revolve.

The rotor profiles discussed above all relate to the theoretical shape thereof. However, in order to guarantee mechanical reliability of the machine in which the rotors are mounted, certain clearances must be provided between the rotors within the portions thereof that shall not directly contact each other.

In order to obtain such clearances one or both rotor profiles must be somewhat modified to deviate from the theoretical shape thereof. The shapes and sizes of those deviations differ for different types of machines depending upon the working condition i.e. compression or expansion, the type of gas to be acted upon the temperature of the gas depending of the cooling system of the machine including liquid injection and the system for transmitting torque to the rotors, such as separate synchronizing gears for interconnection of the rotors, direct flank contact with a driving male rotor and direct flank contact with a driving female rotor, as well as the dimensions of the rotors.

In the drawing the deviation from the theoretical rotor profiles have been disposed completely in the female rotor 30. The shape of the deviations are indicated by the dotted line 128 which for the sake of clearness has been disposed at a very exaggerated distance from the theoretical flank profile. In the drawing (FIG. 3) the deviations have been shown for a compressor with direct flank contact and a driving female rotor 30. The deviations from the theoretical shape over the first and second sections 66–78, 66–88 and 78–82, 88–90 of the major portions of the flanks 62 and 64, respectively, have a constant first size measured perpendicularly to the flank 62, 64. The deviation over the third section 82–74 of the major portion 66–74 of the leading flank 62 diminishes continuously from the size at point 82, being equal to that over the adjacent second section 78–82, to a second minimum size at point 74 on the pitch circle 46. The deviation over the minor flank portion 74–68 is of constant size equal to said second size at point 74 when measured perpendicularly to the flank. The deviations over the third section 90–76 of the major portion 66–76 of the trailing flank 64 and over the minor portion 76–70 of the trailing flank 64 are of a third size. The deviation over the crest 72 except for the sealing strip 124 is of a constant fourth size when measured perpendicularly to the crest 72, i.e. in the radial direction of the rotor. In an actual application related to a compressor for air of atmospheric pressure and temperature, having a pressure ratio of about 8:1, provided with oil injection for cooling, sealing and lubrication, direct flank contact with a driving female rotor 30, and a rotor diameter of about 200 mm, the values of said first, second, third and fourth sizes of deviation are 0.06–0.10 mm, 0.02–0.05 mm, zero, and 0.06–0.10 mm, respectively. For direct flank contact drive and a driving male rotor the values of the second and third sizes of deviation should be interchanged. For drive through synchronizing gears the second and third sizes of deviations should have positive values smaller than the first size of deviation.

By disposing all the clearance producing deviations in one rotor only, preferably the female one, the other rotor will be identical in shape for all different embodiments. In this way the same cutting tool can be used for said other rotor independent of application, and when shifting the production only one new cutting tool has to be prepared which is essential especially from an economy point of view.

The angle "$\beta$" may vary between 0° and 30°. The smaller this angle is the better the contact conditions will be between the cooperating flanks 62, 92. On the other hand the larger this angle is the better are the conditions for a cutting tool, especially when used in a hob milling machine, which means that more rotors can be cut by the same cutting tool without any resharpening thereof. In other words the production of the rotors will be faster and cheaper. An angle "$\beta$" of about 20° as shown in the drawing (FIG. 3) seems to be about an optimum value, at least in the described embodiment of a compressor with direct flank contact and a driving female rotor.

I claim:

1. A pair of intermeshing rotors having helical lands and intervening grooves and adapted for rotation about parallel axes within a working space of a screw rotor machine, one of the rotors being of female rotor type and shaped such that each groove flank circle of the rotor and a minor portion located outside thereof, said minor portion following a curve approaching the adjacent groove when moving from the pitch circle outwardly, and the other of said rotors being of male rotor type and shaped such that each land flank thereof has a major portion located outside the pitch circle of the rotor and a minor portion located inside thereof, characterized in that in a plane perpendicular to the rotor axes said minor flank portion of at least one flank of each male rotor land comprises a first generally straight section located adjacent to the related pitch circle, and a second concavely curved section extending from said first section to the dedendum circle of the rotor, said first flank section forming at its point of intersection with the pitch circle an angle of less than 30°with a radial line drawn through said point of intersection from the center of the rotor.

2. A pair of rotors as defined in claim 1 wherein said first section forms an angle of about 0° with said radial line drawn through said point of intersection with the pitch circle.

3. A pair of rotors as defined in claim 1, in which said angle between said first section and said radial line is about 20°.

4. A pair of rotors as defined in claim 1, in which the flanks of one rotor only deviate from the theoretical shape, whereas the flanks of the other rotor follow the theoretical shape as close as the manufacturing tolerances allow.

5. A pair of rotors as defined in claim 4, in which said deviations have a minimum extent within an area extending a short distance on each side of the pitch circle of the related rotor.

6. A pair of rotors as defined in claim 5, in which said deviations are disposed in the female rotor.

7. A pair of rotors as defined in claim 1 wherein the second section is generated by the tip portion of the corresponding female rotor groove flank.

8. A pair of rotors as defined in claim 7, wherein said minor portion of the female rotor groove flank substantially follows a curve generated by the first section of the minor portion of the trailing flank of the male rotor and has a tangent at its point of intersection with the pitch circle of the female rotor forming an angle with a radial line through said point from the center of the female rotor, said angle having the same value as that of the angle between the first section of the cooperating male rotor land flank and the related radial line.

9. A pair of rotors as defined in claim 8, in which said major and minor flank portions of the female rotor groove have a common tangent and form the trailing flank of the groove, when the rotors are disposed in a compressor.

10. A pair of rotors as defined in claim 9, in which said common tangent passes through the center of the female rotor.

11. A pair of the rotors as defined in claim 9, in which a section of said major portion of the female rotor flank located adjacent to the pitch circle comprises a straight line.

12. A pair of rotors as defined in claim 8, in which said major and minor flank portionsof the female rotor groove have a common tangent and form the leading flank of the groove when the rotors are disposed in a compressor.

13. A pair of rotors as defined in claim 12, in which the trailing flank of the female rotor groove further has major and minor flank portions having a common tangent at their common point on the pitch circle which forms an angle of about 0° with a radial line drawn through said common point of tangency from the center of the rotor.

14. A pair of the rotors as defined in claim 13, in which a section of said major portion of the female rotor flank located adjacent to the pitch circle comprises a straight line.

15. A pair of rotors as defined in claim 8, wherein the major portion of the leading flank of the female rotor comprises three sections, the first section being shaped as a circular arc extending over an angle of about 20° with its center located on the pitch circle, a second section being shaped as a circular arc having its center located outside the pitch circle, and the third section comprises a straight line which forms a tangent to the circular arc of said second section and at a point on the pitch circle and which forms an angle of less than 30° with a radial line drawn through said common point of tangency.

16. A pair of rotors as defined in claim 15, wherein the major portion of the trailing flank of said female rotor comprises three sections, the first section of said trailing flank being a mirror image of the first section of the leading flank, the second section of said trailing flank having at its inner end point a tangent common to that of the first section of said trailing flank and comprises a curve of generally epicycloidal type, and a third section extending from the end of said second section of said trailing flank and comprises a straight radial line drawn from the center of the rotor.

17. A pair of rotors as defined in claim 16, wherein the leading flank of the male rotor comprises a major portion having three sections, the first section of the male rotor leading flank being substantially shaped as a circular arc conforming with the first section of the leading flank of the female rotor, the second section of the leading flank of the male rotor being generated by the second section of the leading flank of the female rotor, and the third section of the male rotor leading flank being generated by the third section of the leading flank of the female rotor.

18. A pair of rotors as defined in claim 17, wherein the major portion of the trailing flank of the male rotor comprises a major portion having three sections, the first section of the male rotor trailing flank being a mirror image of the first section of the male rotor leading flank, the end point of the first section of the male rotor trailing flank further generating the generally epicycloidal second section of the female rotor trailing flank, the second section of the male rotor trailing flank being generated by a point on the trailing flank of the female rotor, and the third section of the male rotor trailing flank being generated by the third section of the trailing flank of the female rotor.

19. Screw rotor machine apparatus for selectively compressing an expanding an elastic working fluid and having a casing with a working space providing with spaced apart high pressure and low pressure ports and including at least two intersecting bores with coplanar axes, a pair of cooperating intermeshing rotors disposed in said bores and having helical lands and intervening grooves, the rotors being adapted for rotation about parallel axes within the working space of the machine, one of the rotors being of female type and shaped such that each groove flank thereof has a major portion located inside the pitch circle of the rotor and a minor portion located outside thereof, said minor portion following a curve approaching the adjacent groove when moving from the pitch circle outwardly, and the other of said rotors being of male rotor type and shaped such that each land flank thereof has a major portion located outside the pitch circle of the rotor and a minor portion located inside thereof, characterized in that in a plane perpendicular to the rotor axes said minor flank portion of at least one flank of each male rotor land comprises a first generally straight section located adjacent to the related pitch circle, and a second concavely curved section extending from said first section to the dedendum circle of the rotor, said first flank section forming at its point of intersection with the pitch circle an angle of less than 30° with a radial line drawn through said point of intersection from the center of the rotor.

20. Apparatus as defined in claim 19, wherein said first section forms an angle of about 0° with said radial line drawn through said point of intersection with the pitch circle.

21. Apparatus as defined in claim 19, in which said angle between said first section and said radial line is about 20°.

22. Apparatus as defined in claim 19, in which said second section is generated by the tip portion of the corresponding female rotor groove flank.

23. Apparatus as defined in claim 19, in which the flanks of one rotor only deviate from the theoretical shape, whereas the flanks of the other rotor follow the theoretical shape as close as the manufacturing tolerances allow.

24. Apparatus as defined in claim 23, in which said deviations have a minimum extent within an area extending a short distance on each side of the pitch circle of the related rotor.

25. Apparatus as defined in claim 24, in which said deviations are disposed in the female rotor.

26. Apparatus as defined in claim 19, in which said minor portion of the female rotor groove flank substantially comprises a curve generated by the first section of the minor portion of the trailing flank of the male rotor and has a tangent at its point of intersection with the pitch circle of the female forming an angle with a radial line through said point from the center of the female rotor, said angle having the same value as that of the angle between the first section of the cooperating male rotor land flank and the related radial line.

27. Apparatus as defined in claim 26, in which said major flank portions of the female rotor groove have a common tangent and form the trailing flank of the groove, when the rotors are disposed in a compressor.

28. Apparatus as defined in claim 27, in which said common tangent passes through the center of the female rotor.

29. Apparatus as defined in claim 27, in which a section of said major portion of the female rotor flank located adjacent to the pitch circle comprises a straight line.

30. Apparatus as defined in claim 26, in which said major and minor flank portions of the female rotor groove have a common tangent and form the leading flank of the groove, when the rotors are disposed in a compressor.

31. Apparatus as defined in claim 30, in which the trailing flank of the female rotor groove further has major and minor flank portions having a common tangent at their common point on the pitch circle which forms an angle of about 0° with a radial line drawn through said common point of tangency from the center of the rotor.

* * * * *

UNITED STATES PATENT AND TRADEMARK OFFICE

CERTIFICATE OF CORRECTION

PATENT NO. : 4,140,445

DATED : February 20, 1979

INVENTOR(S) : Lauritz B. SCHIBBYE

It is certified that error appears in the above-identified patent and that said Letters Patent are hereby corrected as shown below:

In the heading of the patent, change the inventor's first name from "Cauritz" to --Lauritz--;

In Column 6, line 13, after "groove flank", insert --thereof has a major portion located inside the pitch--;

In Column 7, line 27, change "20°" to --10°--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*